US005564689A

United States Patent [19]

Fukube

[11] Patent Number: 5,564,689

[45] Date of Patent: Oct. 15, 1996

[54] PAPER SHEET SEPARATING APPARATUS

[75] Inventor: Noriaki Fukube, Soka, Japan

[73] Assignee: Ricoh Company, Ltd., Tokyo, Japan

[21] Appl. No.: 330,729

[22] Filed: Oct. 28, 1994

[30] Foreign Application Priority Data

Oct. 28, 1993 [JP] Japan ..... 5-270954
Sep. 12, 1994 [JP] Japan ..... 6-217598

[51] Int. Cl.[6] ..... B65H 3/52
[52] U.S. Cl. ..... 271/122
[58] Field of Search ..... 271/121, 122, 271/125

[56] References Cited

U.S. PATENT DOCUMENTS

| | | | |
|---|---|---|---|
| 3,044,770 | 7/1962 | Breuers | 271/122 |
| 4,496,145 | 1/1985 | Fukui | 271/122 |
| 5,039,080 | 8/1991 | Kato et al. | 271/122 |
| 5,050,854 | 9/1991 | Tajima | 271/122 |
| 5,158,279 | 10/1992 | Laffey et al. | 271/122 |
| 5,199,696 | 4/1993 | Kato | 271/122 |
| 5,219,154 | 6/1993 | Fukube et al. | 271/182 |
| 5,316,282 | 5/1994 | Fukube et al. | 271/10 |
| 5,322,269 | 6/1994 | Fukube et al. | 271/18.1 |
| 5,382,014 | 1/1995 | Fukube | 271/18.1 |

FOREIGN PATENT DOCUMENTS

| | | | |
|---|---|---|---|
| 59-69328 | 4/1959 | Japan . | |
| 3256944 | 11/1991 | Japan | 271/122 |
| 2244264 | 11/1991 | United Kingdom | 271/121 |

*Primary Examiner*—H. Grant Skaggs
*Assistant Examiner*—Tamara Kelly
*Attorney, Agent, or Firm*—Oblon, Spivak, McClelland, Maier & Neustadt, P.C.

[57] ABSTRACT

A paper sheet separating apparatus has a feeding roller to feed a paper sheet in a transporting direction and a reversing roller to give a predetermined torque in the opposite direction to the transporting direction so that paper sheets are separated and fed one by one from accommodated paper sheets. The paper sheet separating apparatus includes a reversing roller mounted on a reverse shaft via a torque limiter. The torque limiter includes a clutch body which rotates integrally with the reverse shaft, a hub which is rotatably supported on the shaft and a spring which is disposed between the clutch body and the hub. The hub forms a part of the reversing roller.

5 Claims, 2 Drawing Sheets

PAPER SHEET SEPARATING APPARATUS

BACKGROUND OF THE INVENTION

1. Field of the Invention

This invention relates to a paper separating apparatus, especially to a paper separating apparatus having a feeding roller and a reversing roller which cooperates with the feeding roller and has a torque limiter.

2. Description of the Related Art

FIG. 5 shows a paper feeding apparatus used in an image forming apparatus such as an electrophotographic copying machine, a facsimile or a printer, such as that shown in Japanese Laid Open Patent 59-69328. A top of a bundle of paper sheets 100 in a cassette case is picked up by pick up roller 11 and fed to a separating unit. The separating unit comprises a feeding roller 10 which feeds a single (top) paper sheet in a feeding direction, and a reversing roller 2, which rotates in a direction opposite to the feeding direction, and with a predetermined torque. The reversing roller 2 cooperates with the feeding roller 10 to prevent additional sheets, other than the top sheet from being fed by the feeding roller. The reversing roller is pressed toward the feeding roller by a pressing lever 6 and a pressing spring 7. The feeding and reversing rollers are thus maintained in contact with one another, except when a sheet of paper intervenes.

After a paper sheet is separated in a nip between the feeding roller 10 and the reversing roller 2, the paper sheet is transported to the image forming apparatus (not shown) via a pair of resist rollers 8 along a guide plate 9. An image is then formed on one side or both sides of the paper sheet.

The reversing roller 2 is provided on an end of a reverse shaft 3 (FIG. 1). The other end of the reverse shaft 3 is supported so that the reversing roller 2 is movable toward the feeding roller axis. The reverse shaft is driven so as to rotate in a direction opposite to the rotating direction of the feeding roller shaft. Circlips 5 hold the rollers on their respective shafts.

A torque limiter of a clutch type is used to limit the rotating torque applied by the reverse shaft to the reversing roller to a predetermined value. As shown in FIG. 1, a conventional torque limiter comprises a spring 1*a*', hub 1*c*' and a clutch body 1*b*'. (The conventional torque limiter of FIG. 1 is not admitted as being prior art as defined in 35 USC § 102.) The clutch body 1*b*' is mounted so as to rotate integrally with the reverse axis 3, and the hub 1*c*' is mounted rotatably on the axis 3 and rotates together with the (separate) reversing roller via an engaging portion. The spring 1*a*' is disposed between the clutch body 1*b*' and the hub 1*c*'.

The clutch body 1*b*' and the hub 1*c*' have coaxial cylindrical parts which closely surround the shaft 3. The spring is wound on the coaxial cylindrical parts and so presses them onto the shaft 3 with a certain interference force and transmits torque between the clutch body and the hub. However, when the shaft 3 is rotated in the direction shown by the arrow, the corresponding rotation of the clutch body 1*b*' tends to unwind the spring 1*a*', and so reduce the interference force of the spring on the hub 1*c*'. The amount of torque applied by the shaft 3 onto the roller 2 can therefore be limited so that the shaft 3 can rotate without rotating the roller 2 if a force resisting the rotation of the roller exceeds the frictional force between the hub 1*c*' and the shaft 3.

in the conventional reversing roller described above, the number of the parts is large, and so it takes much time to assemble and maintain these parts. It is also necessary to provide the engaging portion so as to surely transmit rotation. Since a roller portion and a torque limiter portion are independently provided, it is necessary to use a long space in the axial direction.

SUMMARY OF THE INVENTION

The present invention has an object to overcome the above and other problems encountered in the aforementioned art.

It is a further object of the present invention to provide a paper separating apparatus which is maintained easily and is low in cost.

The above mentioned objects of the present invention are achieved by a paper sheet separating apparatus including a feeding roller positioned for feeding one of a plurality of paper sheets in a transporting direction and a reverse shaft rotatable in a reverse direction opposite to said feeding roller. A reversing roller forming a nip with the feeding roller is mounted on the reverse shaft so as to reverse paper sheets other than the one paper sheet in said nip. A torque limiter is positioned on the reverse shaft such that the reversing roller is mounted on the reverse shaft via the torque limiter. The torque limiter includes a hub rotatably supported on the shaft, the hub forming a part of the reversing roller; a clutch body mounted on the shaft so as to rotate integrally therewith, the clutch body fitting at least partially into the hub; and a torque limiting member connecting the clutch body with the hub such that rotation of the clutch body is transferred to the hub with a limited torque.

BRIEF DESCRIPTION OF THE DRAWINGS

Other objects and further features of the present invention will become apparent from the following detailed description when read in conjunction with the accompanying drawings, wherein.

DESCRIPTION OF THE PREFERRED EMBODIMENTS

A description will now be given of preferred embodiments according to the present invention.

Figure 2:
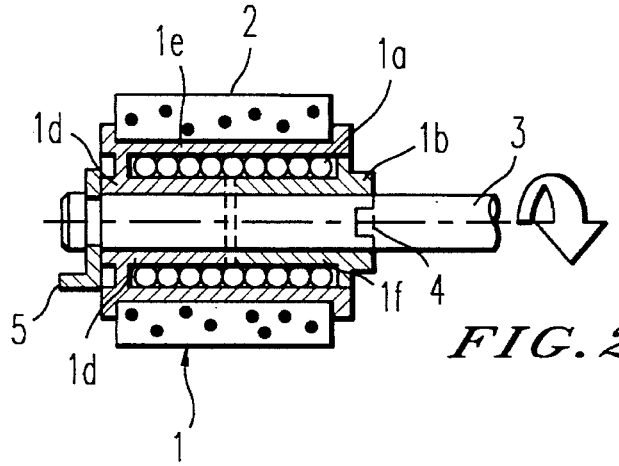
FIG. 2 is a sectional view of a reverse roller portion according to a first embodiment of the present invention.

FIG. 2 is a sectional view of a reversing roller 2 having a torque limiter 1 according to the first embodiment of the present invention. The torque limiter includes a hub 1*c* rotatably mounted at one end of the reverse shaft 3, and is held thereon by a circlip 5 which fits in an end groove of the shaft 3. The hub 1*c* has an inner cylindrical portion 1*d* which fits closely around the shaft 3 and an integral outer cylindrical portion 1*e* surrounding the inner cylindrical portion. The roller 2 is formed by the outer cylindrical portion.

The clutch body 1*b* has a cylindrical portion 1*f* which fits into the hub 1*c* and also fits closely around the shaft 3 coaxially with the inner cylindrical portion 1*d*. A pin 4 extends through a recess of the clutch body to rotatably couple the shaft 3 and the clutch body, and cooperates with the circlip 5 to axially position the torque limiter.

Figure 1:
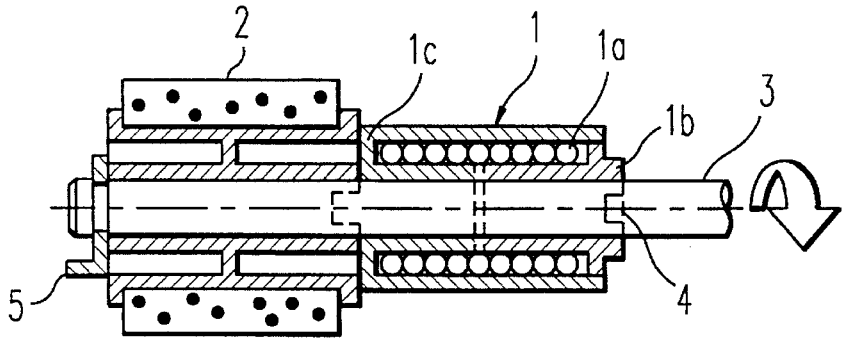
FIG. 1 is a sectional view of a conventional reverse roller portion.

A spring 1*a* is wound on the coaxial cylindrical portions 1*d* and 1*f* with a certain interference due to tightening of the spring and, as in FIG. 1, transmits torque between the shaft 3, via the clutch body, and the hub. Also as in FIG. 1, the spring tends to unwind, and the transmitted torque is limited due to the resulting reduced interference, when the shaft 3 is rotated in the arrow direction.

In case there is not a predetermined load on the reversing roller 2, since the spring 1*a* tightens the clutch body 1*b* and the hub 1*c*, the roller 2 mounted on the hub 1*c* rotates with the shaft 3. However, in case there is a predetermined load on the reversing roller 2, since the spring 1*a* becomes loosened as the clutch body 1*b* rotates with the shaft 3, the spring 1*a* slides on the clutch body 1*b*, and the rotation of the shaft 3 is not transmitted to the clutch body 1*b*.

In this embodiment, when the feeding roller 10 rotates in a paper transporting direction, the reverse shaft 3 rotates in a paper reversing direction. However, when there is no or only one paper sheet between the feeding roller 10 and the reversing roller 2, the transmitting torque of the torque limiter is smaller than the frictional force between the feeding roller 10 and the reversing roller 2 or the frictional force between the reversing roller 2 and the paper sheet. The reversing roller 2 therefore rotates with the feeding roller 10 while the spring 1*a* slides on the cylindrical portion of the hub 1*c*.

When there is more than one paper sheet between the reversing roller 2 and the feeding roller 10, the friction between the paper sheets is smaller than that between the paper sheet and the reversing roller 2 or the feeding roller 10, and further the transmitting torque of the torque limiter 1 is bigger than the frictional force between the paper sheets. The reversing roller 2 therefore rotates with the reverse shaft 3 in a paper reversing direction so that the excess paper sheets are reversed in order until only one paper sheet remains between the reversing roller 2 and the feeding roller 10, and the one paper sheet is fed.

The spring 1*a* of the torque limiter 1 is made of resin with high elastic characteristic, such as polycarbonate and the clutch body 1*b* and the hub 1*c* are made of low friction resin such as polyacetal.

In this embodiment, the reversing roller 2 is mounted on the hub 1*c* of the torque limiter, and so a maintenance operation for exchanging the reversing roller 2 can be performed simply by removing the stop ring 5 and replacing the combined hub and reversing roller 2. Replacement of a worn roller 2 can therefore be easily accomplished. In a clutch type torque limiter, wear of the contacting part of the clutch body 1*b* or the hub 1*c* and the spring 1*a* causes a decline in the transmitted torque. The present invention has the added advantage that, since the replacement of the reversing roller 2 also results in the replacement of the torque limiter 1 (the clutch body 1*b*, the hub 1*c* and/or the spring 1*a*), excessive loss of torque can be prevented.

Further, in this embodiment, the hub 1*c* which is integrally formed with the reversing roller 2 is short and almost all of the clutch body 1*b* and all of the spring 1*a* are accommodated within the axial limits of the reversing roller 2. The torque limiter 1 and the reversing roller 2 can therefore be constructed in the same space as the conventional reversing roller and it is possible to make the total length of the reversing roller and the torque limiter short in the axial direction.

Figure 3:
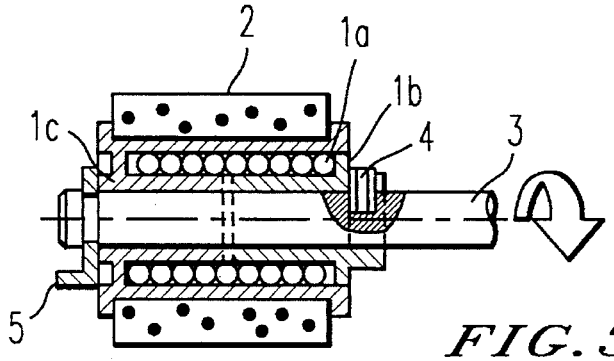
FIG. 3 is a sectional view of a reverse roller portion according to a second embodiment of the present invention.

FIG. 3 is a sectional view of a reversing roller according to the second embodiment of the present invention. In this embodiment, the clutch body 1*b* of the torque limiter 1 is fixed on the reverse shaft 3 by a holding screw 4 so that the clutch body 1*b* and the reverse shaft 3 integrally rotate. Since the clutch body 1*b* is fixed on the shaft 3, it is possible to limit the exchanged parts during maintenance to those part which wear rapidly.

Figure 4:
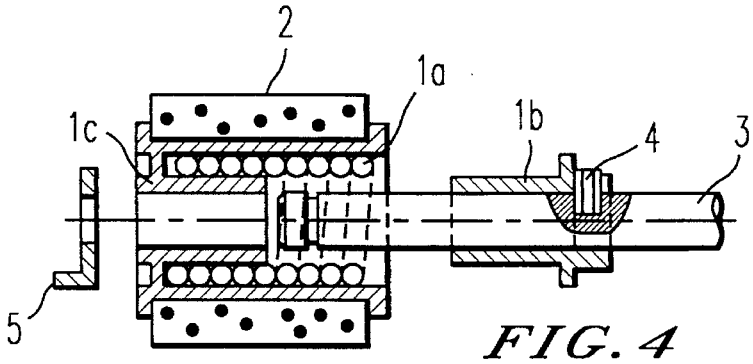
FIG. 4 is a view of the parts in FIG. 3 during an exchanging operation.
Figure 5:
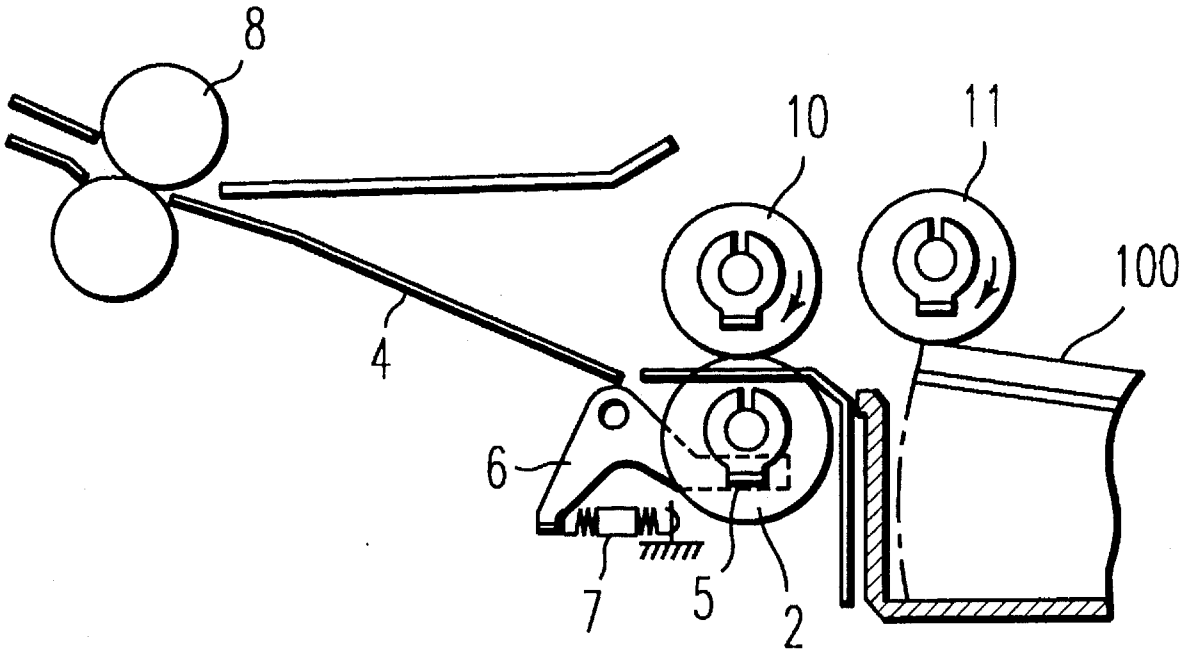
FIG. 5 is a front view of a conventional paper separating apparatus.

As shown in FIG. 4, in an exchanging operation, the clutch body 1*b* which has a long life span remains on the shaft 3 when the hub and roller are replaced. It is thus possible to reduce the number of the parts for replacement, thereby lowering costs.

The above described embodiments refer to a paper sheet separating apparatus which separates and feeds a top paper sheet from the accommodated paper sheets, but the present invention can also be applied to a duplicating copying machine or a paper sheet refeeding apparatus having a paper sheet separating apparatus which separates and feeds a bottom paper sheet from the accommodated paper sheets.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A paper sheet separating apparatus comprising:

a feeding roller positioned for feeding one of a plurality of paper sheets in a transporting direction;

a reverse shaft rotatable in a reverse direction opposite to said feeding roller;

a reversing roller forming a nip with the feeding roller, said reversing roller being mounted on said reverse shaft so as to reverse paper sheets other than said one paper sheet in said nip; and a torque limiter positioned on said reverse shaft such that said reversing roller is mounted on said reverse shaft via said torque limiter, wherein said torque limiter comprises:

a) a hub rotatably supported on said shaft, said hub forming a part of said reversing roller, b) a clutch body mounted on said shaft so as to rotate integrally therewith, said clutch body fitting at least partially into said hub, and c) a torque limiting member comprising a spring positioned at least partially within said hub and connecting said clutch body with said hub such that rotation of said clutch body is transferred to said hub with a limited torque, wherein said hub includes an outer cylindrical portion on which said reversing roller is formed and an inner cylindrical portion integral with said outer cylindrical portion and mounted on said shaft, said clutch body includes a cylindrical portion mounted on said shaft adjacent said inner cylindrical portion of said hub, and said spring is wound on both said inner cylindrical portion of said hub and said cylindrical portion of said clutch portion.

2. The paper sheet separating apparatus of claim 1 wherein both said inner cylindrical portion of said hub and said cylindrical portion of said clutch portion are at least partially within a space axially bounded by said outer cylindrical member of said hub.

3. The paper sheet separating apparatus of claim 1 wherein both said inner cylindrical portion of said hub and said cylindrical portion of said clutch portion are fully within a space axially limited by said outer cylindrical member of said hub.

4. The paper sheet separating apparatus of claim 1 including a pin fixing said clutch body onto said shaft.

5. The paper sheet separating apparatus of claim 1 wherein said hub, said clutch body and said spring are made of resin.

* * * * *